US010689770B2

(12) United States Patent
Hop et al.

(10) Patent No.: US 10,689,770 B2
(45) Date of Patent: Jun. 23, 2020

(54) MODIFIED ELECTROLYSIS CELL AND A METHOD FOR MODIFYING SAME

(71) Applicant: NORSK HYDRO ASA, Oslo (NO)

(72) Inventors: Jørund Hop, Årdalstangen (NO); Anders Lilleby, Årdalstangen (NO); Asgeir Bardal, Oslo (NO); Nils-Håvard Giskeødegård, Skien (NO); Sipke Paulides, Årdalstangen (NO); Robert Jørgensen, Årdalstangen (NO)

(73) Assignee: NORSK HYDRO ASA, Oslo (NO)

( * ) Notice: Subject to any disclaimer, the term of this patent is extended or adjusted under 35 U.S.C. 154(b) by 201 days.

(21) Appl. No.: 15/537,957

(22) PCT Filed: Dec. 22, 2015

(86) PCT No.: PCT/NO2015/000030
§ 371 (c)(1),
(2) Date: Jun. 20, 2017

(87) PCT Pub. No.: WO2016/105204
PCT Pub. Date: Jun. 30, 2016

(65) Prior Publication Data

US 2017/0350028 A1 Dec. 7, 2017

(30) Foreign Application Priority Data

Dec. 23, 2014 (NO) ..... 20141572

(51) Int. Cl.
*C25C 3/06* (2006.01)
*C25C 3/12* (2006.01)
(Continued)

(52) U.S. Cl.
CPC ..... *C25C 3/20* (2013.01); *C25C 3/08* (2013.01); *C25C 3/10* (2013.01); *C25C 3/125* (2013.01); *C25C 3/16* (2013.01)

(58) Field of Classification Search
CPC .... C25C 3/06; C25C 3/08; C25C 3/12; C25C 3/18; C25C 7/06; C25C 7/005; C25C 3/00; C25C 7/02
(Continued)

(56) References Cited

U.S. PATENT DOCUMENTS

| | | | |
|---|---|---|---|
| 3,385,778 | A | 5/1968 | Johnson |
| 3,787,311 | A | 1/1974 | Wittner et al. |
| 6,231,745 | B1 | 5/2001 | Homley et al. |

FOREIGN PATENT DOCUMENTS

| | | |
|---|---|---|
| CN | 201162052 | 12/2008 |
| EP | 0 016 728 | 10/1980 |

(Continued)

OTHER PUBLICATIONS

International Search Report dated Mar. 17, 2016 in corresponding International PCT Application No. PCT/NO2015/000030.

(Continued)

*Primary Examiner* — Zulmariam Mendez
(74) *Attorney, Agent, or Firm* — Wenderoth, Lind & Ponack, LLP

(57) ABSTRACT

A method for optimizing stability in an electrolysis cell of the Hall-Héroult type where the cell has suspended prebaked anodes and a cathode panel. The panel comprises several cathode blocks or cathode block sections. A metal pad and an electrolytic bath are located between said anodes and the cathode panel. The force field acting on the metal pad is calculated and monitored in a computer based model of the cell, whereby the local current paths and correspondingly the local forces in the metal above the cathode panel are
(Continued)

Figure 1:
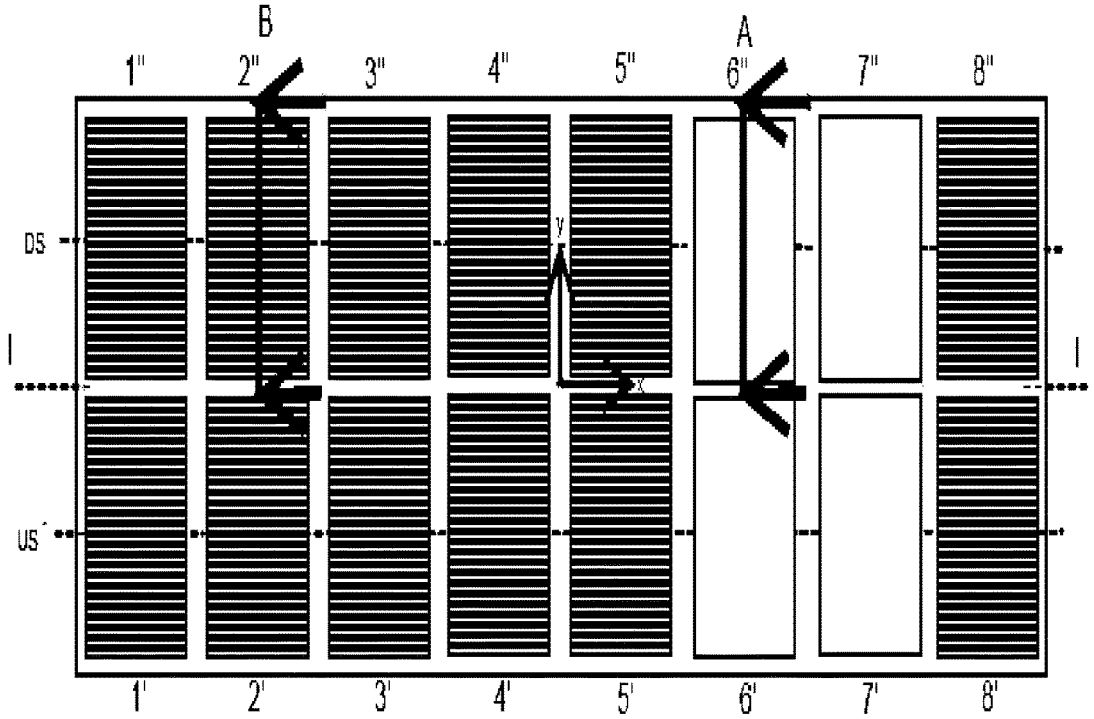

modified by influencing selectively the current distribution in individual cathode blocks or block sections in the computer based model. At least one modification is implemented in the cell. The invention also relates to a correspondingly modified cell.

22 Claims, 11 Drawing Sheets

(51) Int. Cl.

| | |
|---|---|
| ***C25C 3/18*** | (2006.01) |
| ***C25C 7/06*** | (2006.01) |
| ***C25C 3/00*** | (2006.01) |
| ***C25C 7/02*** | (2006.01) |
| ***C25C 3/20*** | (2006.01) |
| ***C25C 3/16*** | (2006.01) |
| ***C25C 3/08*** | (2006.01) |
| ***C25C 3/10*** | (2006.01) |

(58) Field of Classification Search
USPC ..... 205/372
See application file for complete search history.

(56) References Cited

FOREIGN PATENT DOCUMENTS

| | | |
|---|---|---|
| EP | 0 371 653 | 6/1990 |
| NO | 139829 | 2/1979 |
| NO | 140602 | 6/1979 |
| WO | 2008/062318 | 5/2008 |
| WO | 2013/016930 | 2/2013 |

OTHER PUBLICATIONS

Written Opinion of the International Searching Authority dated Mar. 17, 2016 in corresponding PCT Application No. PCT/NO2015/000030.

Jinsong Hua et al., "Revised benchmark problem for modeling of metal flow and metal heaving in reduction cells" TMS Light Metals, 2014, pp. 691-695.

MODIFIED ELECTROLYSIS CELL AND A METHOD FOR MODIFYING SAME

The present invention relates to a method for reducing the metal pad unevenness and optimizing the MHD (magnet hydrodynamic) stability in an electrolysis cell of the Hall-Héroult type for aluminium production, and a correspondingly modified cell.

To improve the production yield of electrolysis cells for aluminium production, cells have been designed larger and also with higher production current.

As the footprint of the liquid (electrolyte and aluminium metal) increases in the cells, the balance of the magnetic fields that influences the conducting liquid will be more critical.

As the production current tends to increase even above 400 kA, controlling the strong influence of the magnetic fields generated from the various conductors and current leads in and around the cell will represent a challenge when designing new cells, and the anode/cathode construction as well as the bus bar system has to be designed carefully. The magnetic fields of any neighbouring potline (a plurality of cells in a series) will also become more potent with increased production current (line current) and must be considered carefully.

Similarly, when existing cells are tuned up with regard to an increase in the production current, several challenges may occur with regard to the magnet hydrodynamic (MHD) instability in the metal pad of cells. MHD instability is among other factors influenced by velocity fields and also metal heaving.

In the prior art there are several publications relating to optimizing the shape of the metal pad and the metal flow in an electrolysis cells. In addition there are modelling tools available to calculate force and velocity fields and also metal heaving, as well as MHD stability in the metal pad.

For instance, a modelling tool for calculating force and velocity fields as well as metal heaving is disclosed in the following article:

"Revised benchmark problem for modeling of metal flow and metal heaving in reduction cells", Hua, J., Droste, C., Einarsrud, K. E., Rudshaug, M., Jørgensen, R., Giskeodegard, N.-H., TMS Light Metals 2014, p 691-695.

EP0371653B1 discloses an asymmetric arrangement of busbars beneath one transversally arranged cell to improve the $B_z$-field in the cell.

However, brown field modifications of the busbar system of a potline is rather cumbersome and power interruptions of the whole potline may be necessary to make modifications.

According to previous Norwegian patents NO139829 and NO140602 it is advantageous for cell MHD stability to conduct more current in an unsymmetrical busbar system around or under the short end of the cell which is closer to the neighbouring row or rows.

However, the uneven busbar system sets up forces in the metal that predominantly pushes the metal away from the neighbouring rows and results in an uneven distribution of metal in the cell, and an increased metal pad curvature that also can be asymmetric where metal tends to allocate at one end of the cell.

An increased metal pad curvature or metal pad unevenness will lead to an uneven bath distribution which will potentially lead to a worsened oxide distribution.

An increased metal pad curvature that also is asymmetric will lead to an uneven wear of single anode and will therefore results in on average larger anode butts.

An asymmetric distribution of metal (tap vs. duct side of cell or upstream vs. downstream) might also result in uneven heat loss, due to possible difference in heat transfer coefficients between bath and metal and the side ledge.

There are also several publications relating to methods for influencing the current distribution in a cathode block and the corresponding cathode panel. The modification can relate to the conductivity of the cathode block material, the collector bar or the electrical connection between the cathode block and the collector bar i.e. the assembly of cathode block and collector bar.

Commonly this can be done in several ways:

i) Cathode block quality, i.e. the electrical conductivity of the carbon based body may vary along the length of the body, commonly with higher conductivity towards the centre of the cell, or be modified as a whole,
ii) Cathode collector bars with improved conductivity, for instance by use of Cu inserts
iii) Cathode collector bar dimension (cross-section increase) to reduce the voltage drop
iv) Various methods for insulating electrically the cathode bar from the carbon based cathode block
v) Reduced electrical conductivity in the modified cathode block With conventional use of these methods it has proven difficult in some cases to reduce metal curvature or optimize metal flow without sacrificing MHD stability and vice versa.

WO2008/062318 discloses the use of a bar complementary to a collector bar, where said complementary bar, preferably of copper, has an electrical conductivity greater than that of the ferrous collector bar. Said collector bar and complementary bar are preferably electrically insulated from the cathode block in the end regions of the block. By this solution it is possible to reduce the cathode voltage drop and also reduce the heat losses towards the outside of the cell.

U.S. Pat. No. 6,231,745 discloses the use of copper inserts in collector bars, and how this can be applied to redirect current in a Hall-Héroult cell to reduce or eliminate inefficiencies attributable to non-uniform and/or horizontal currents. The modifications are done in a symmetrical manner along a central long-axis of the cell.

Other examples of a basically symmetric approach to modify electrolysis cells are:

WO 2013/016930 A1, CN 201162052 Y, U.S. Pat. No. 3,385,778 A.

U.S. Pat. No. 3,787,311 A discloses a step-wise symmetric approach.

EP0016728 A1 discloses a diagonal symmetric approach.

Commonly these methods may rely on a "skilled man's eye", where modifications are done in certain areas for instance where the concentration of busbars are high or to modify the extraction of current via the cathode in a more vertical manner.

Conventional cells are relined periodically, say each 5-7 year. During this operation the cathodic elements such as cathode blocks included its collector bars are all taken out and renewed. This is a quite costly maintenance job that is done at the end of the 'lifespan' of the cell.

If cathode block assemblies at certain selected positions in the cathode panel are modified by a merely trial and fail method in full scale, this would be associated with the risk of having more frequent relining and the corresponding costs.

With the present invention it is possible determine how to selectively modify the electrical conductivity of singular or plural cathode block assemblies, or cathode block sections assemblies to reduce the above mentioned disadvantages.

This is done by establishing a model of the actual electrolysis cell in computer based modelling program where each cathode block assembly or cathode block section assembly is represented. The modelling program is able to identify which cathode block assembly or cathode block section assembly that preferably should be modified. At least one of the modifications is implemented in the cell by changing selectively the current distribution in individual cathode block assemblies or in cathode block section assemblies, so that the local current paths and correspondingly the local forces in the metal above the cathode panel are modified to enhance the unevenness of the metal pad and the overall MHD stability of the cell.

These and further advantages can be achieved with the present invention as defined by the accompanying claims.

Figure 2:
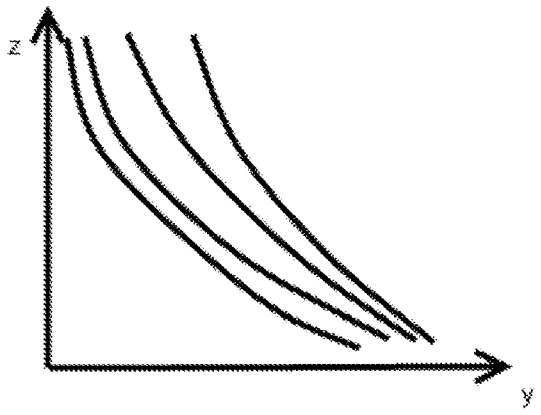
Figure 3:
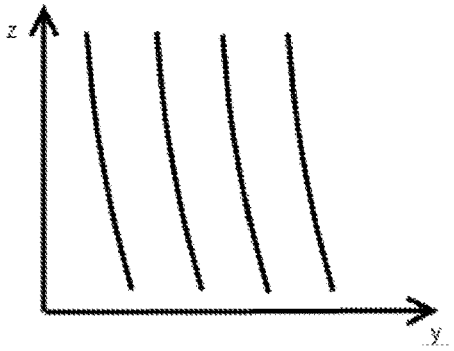
Figure 4:
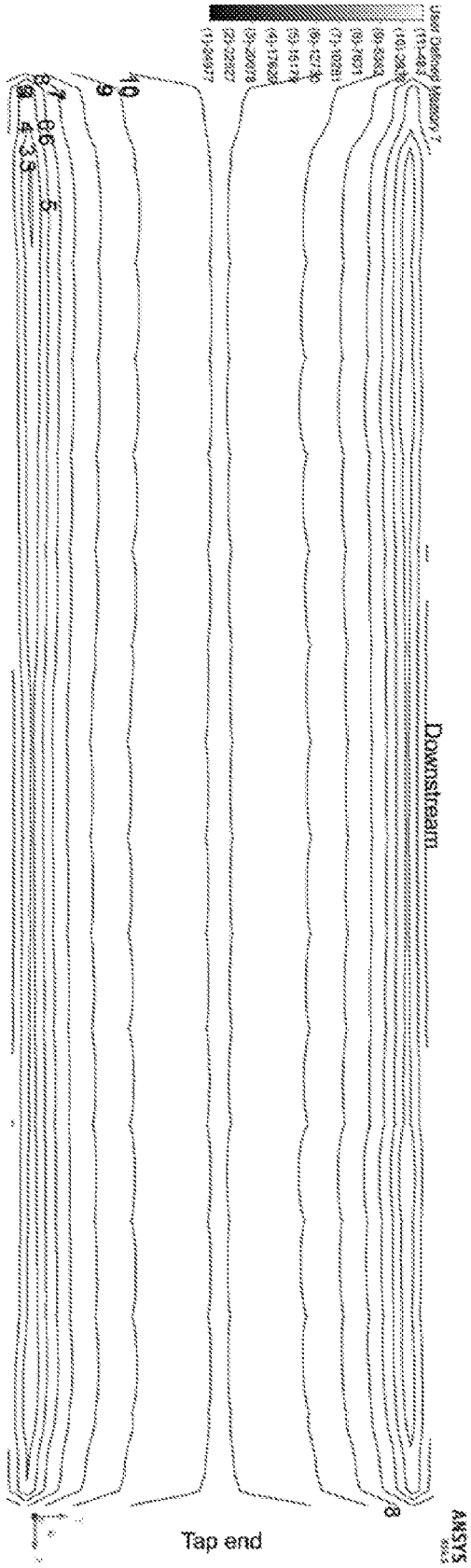
Figure 5:
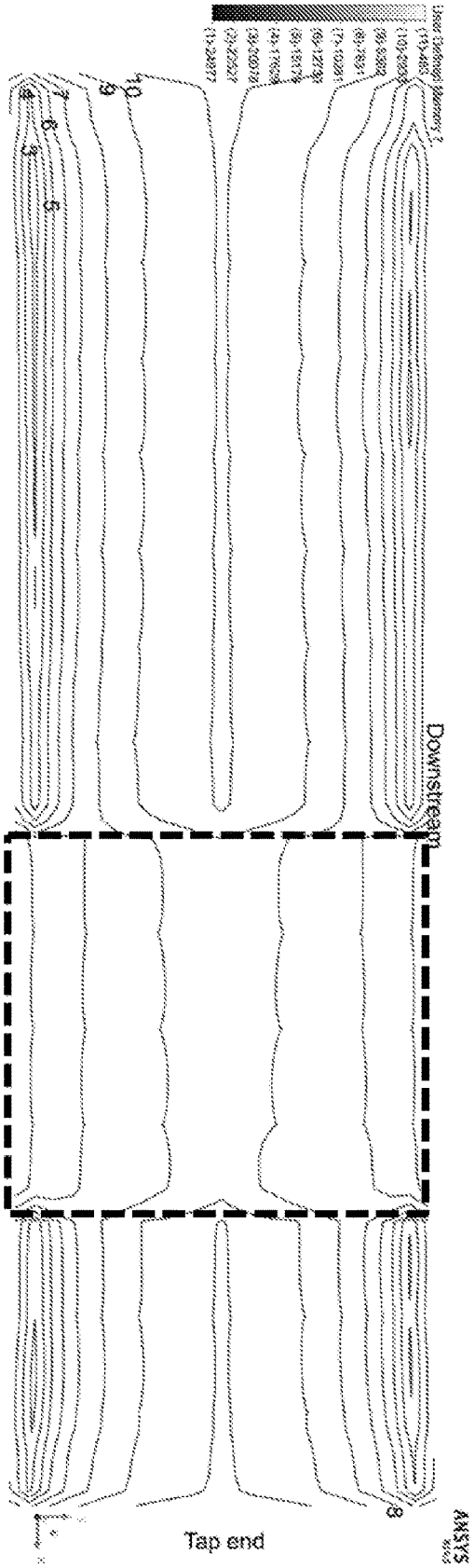
Figure 6:
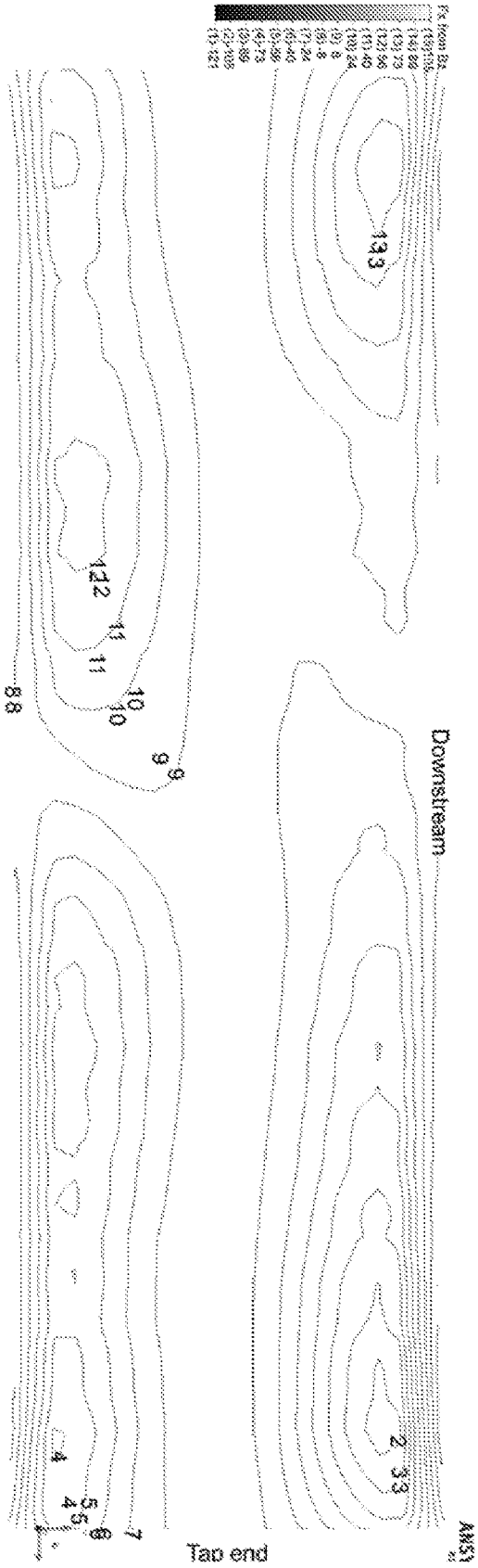
Figure 7:
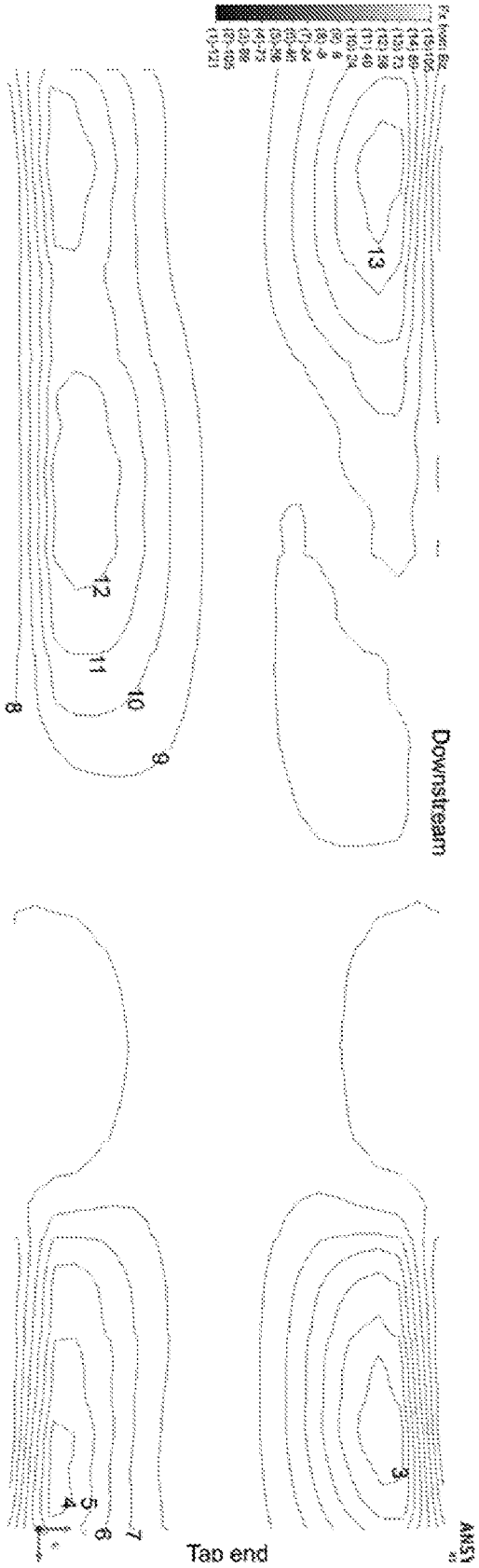
Figure 8:
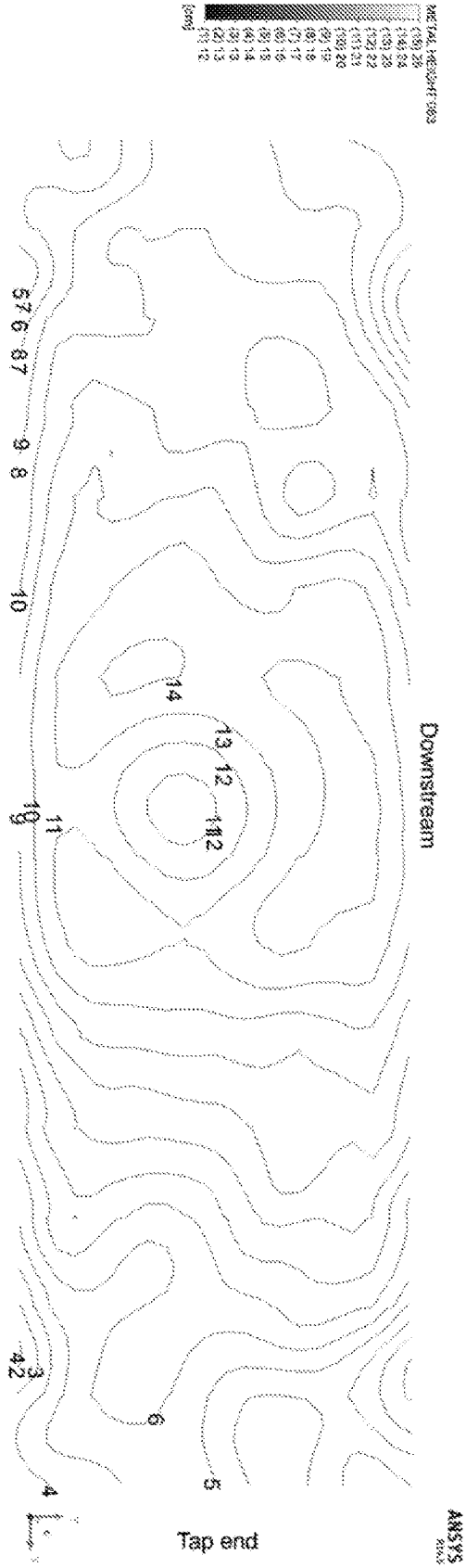
Figure 9:
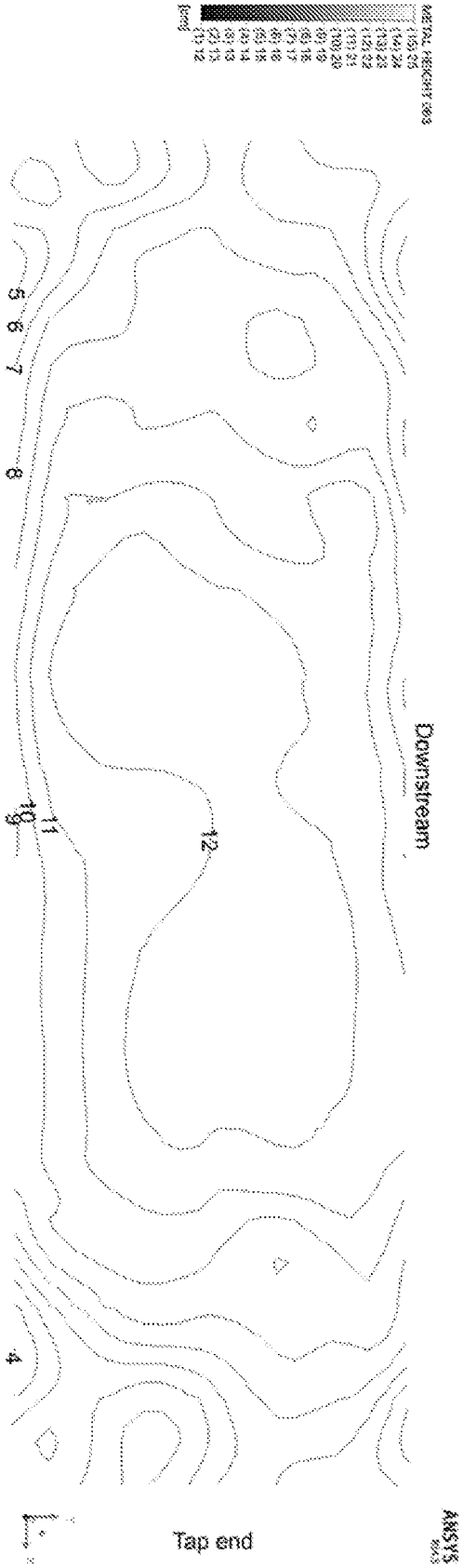
Figure 10:
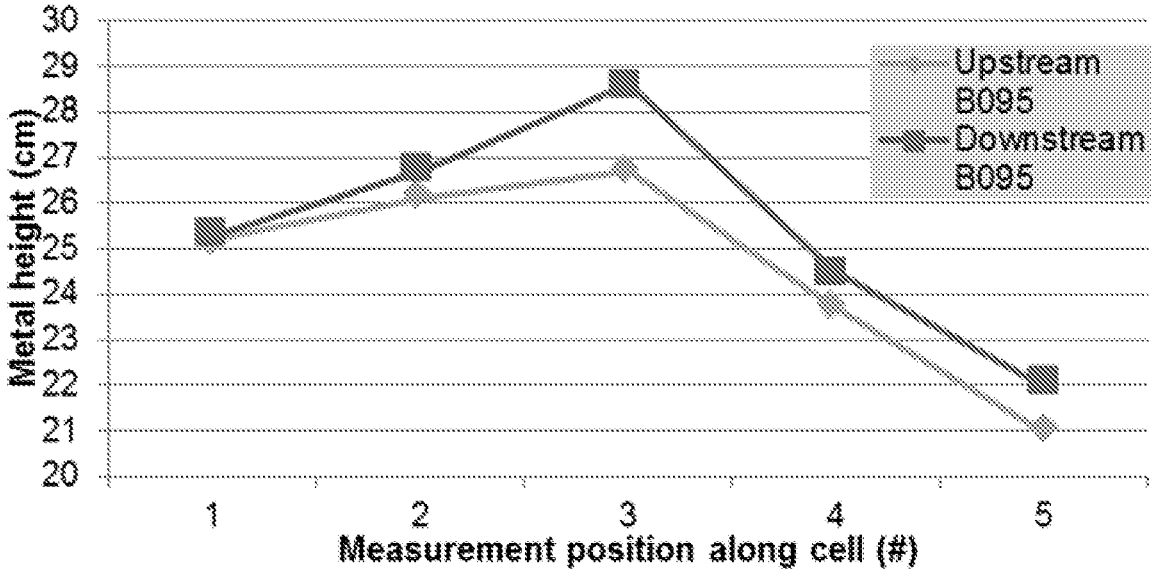
Figure 11:
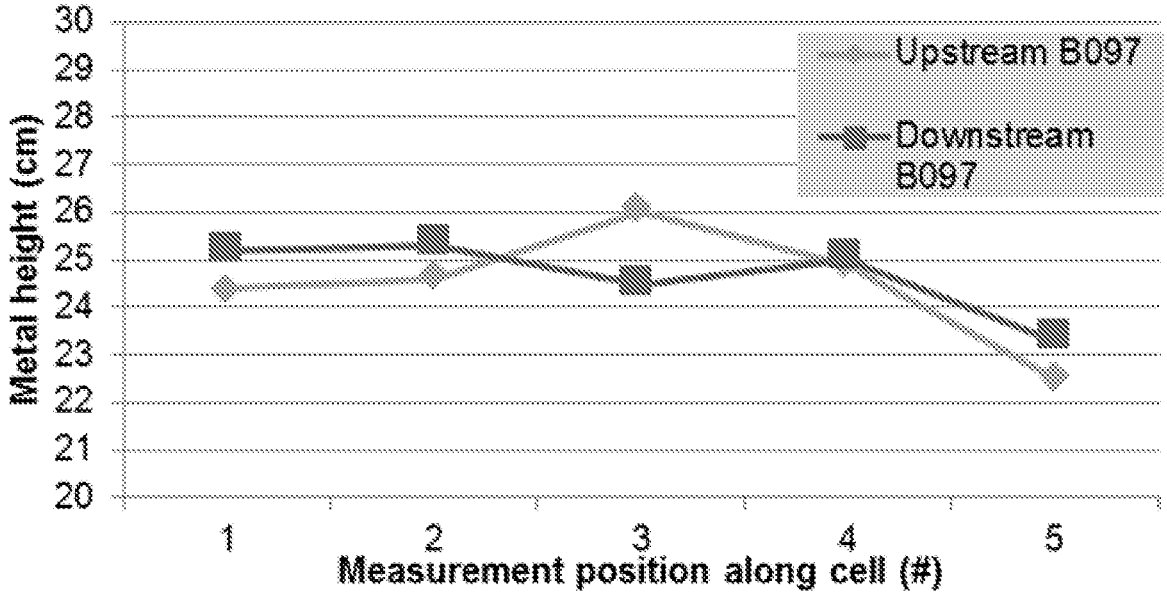
Figure 12:
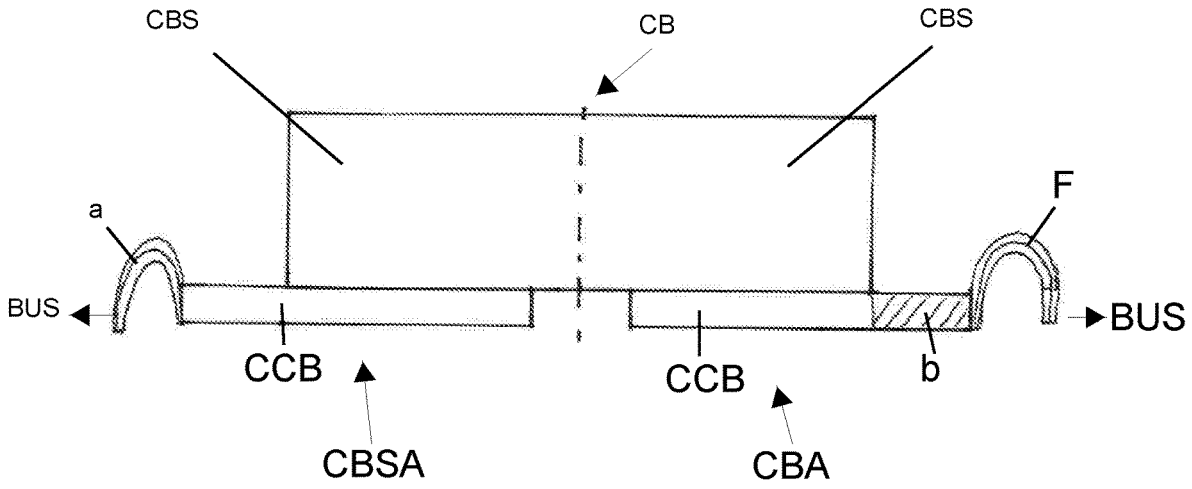
Figure 13:
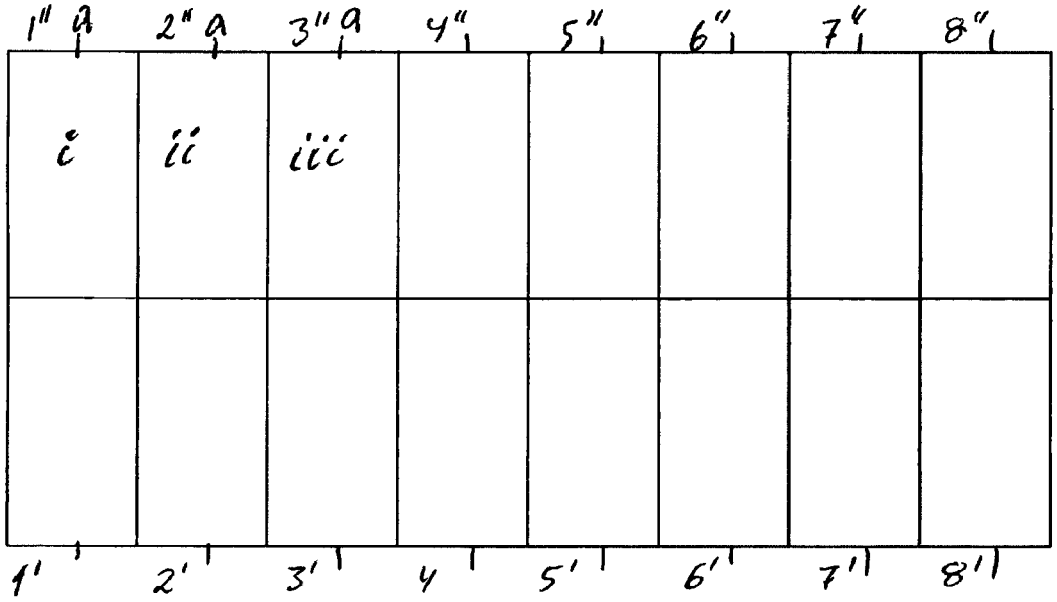
Figure 14:
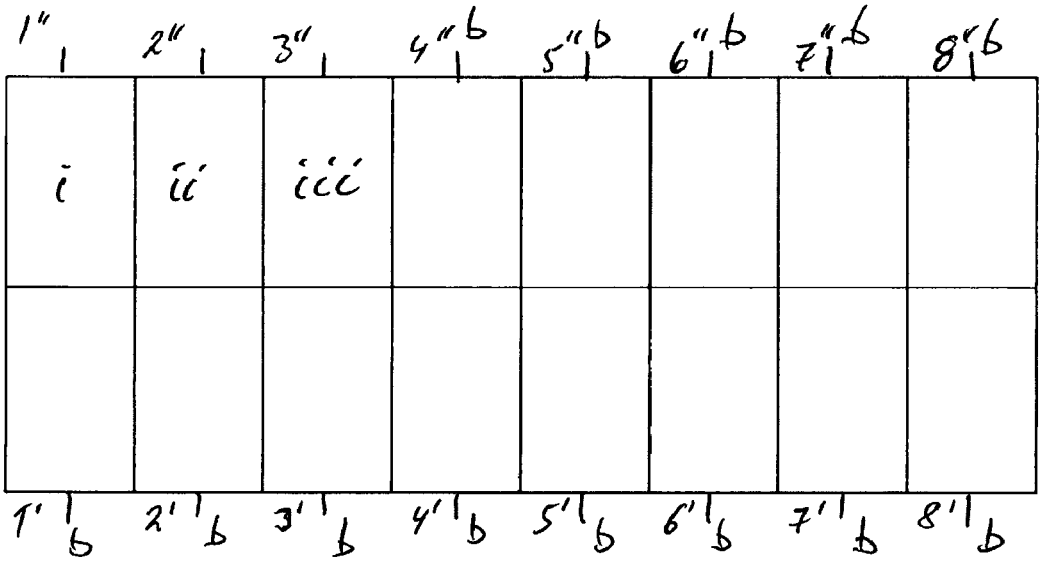
Figure 15:
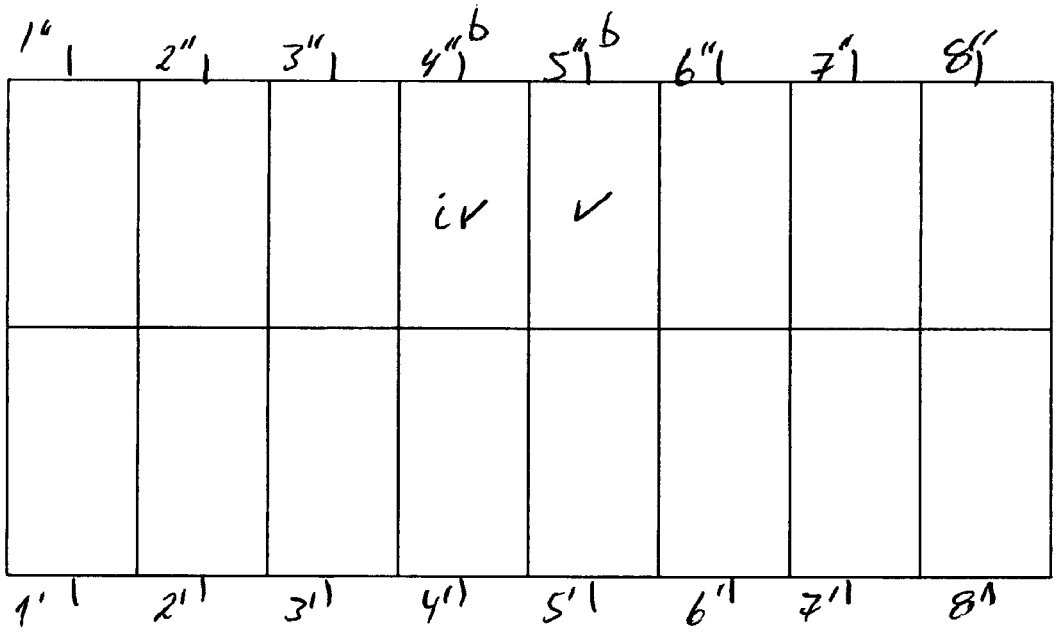
Figure 16:
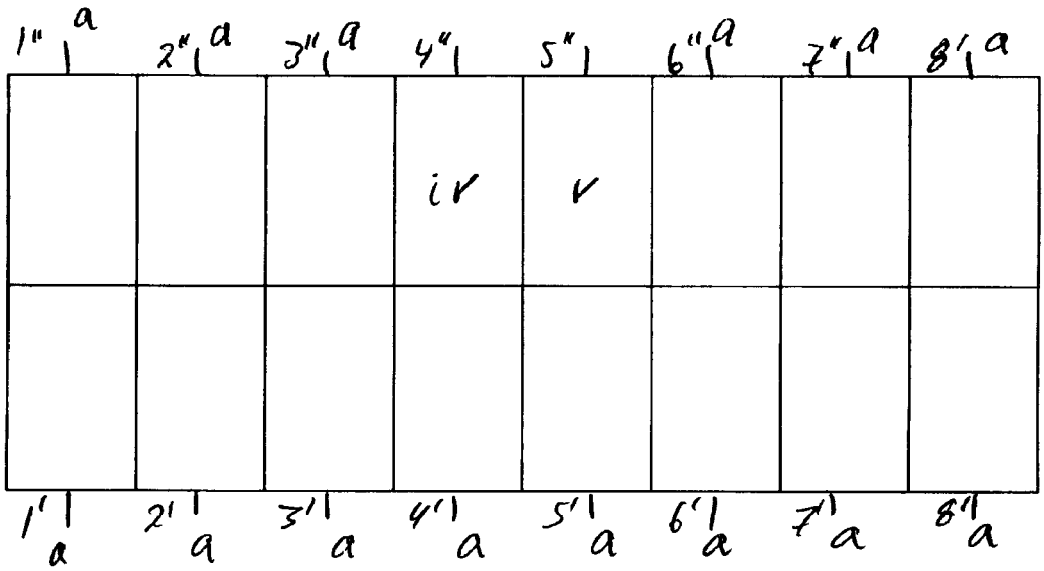

In the following, the invention will be further explained by examples and Figures where;

FIG. 1 discloses a schematic top view of an electrolysis cell,

FIG. 2 discloses typical current paths in a normal cathode block assembly,

FIG. 3 discloses current paths in a modified cathode block assembly,

FIG. 4 discloses current distribution in an electrolysis cell with normal overall cathode assembly, FIG. 5 discloses current distribution in an electrolysis cell with modified overall cathode assembly, FIG. 6 discloses force components (x-direction) in metal due to the magnetic field in the z-direction for a normal cell, FIG. 7 discloses force components (x-direction) in metal due to the magnetic field in the z-direction for a selectively modified cell, FIG. 8 discloses modelled metal heights for a normal cell, FIG. 9 discloses modelled metal heights for a modified cell, FIG. 10 discloses measured metal heights for a normal cell, FIG. 11 discloses measured metal heights for a modified cell, FIG. 12 discloses a cathode block assembly with cathode bar connections, FIG. 13 discloses a schematic top view of an electrolysis cell with modified cathode block section assemblies, FIG. 14 discloses a schematic top view of an electrolysis cell with modified cathode block section assemblies, FIG. 15 discloses a schematic top view of an electrolysis cell with modified cathode block section assemblies, FIG. 16 discloses a schematic top view of an electrolysis cell with modified cathode block section assemblies.

Related to this invention, a carbon based cathode block having one or more collector bar is named cathode block assembly. The block may consist of two cathode block sections where each section includes the cathode bars. Each section, including the cathode bar(s), is here defined as a cathode block section assembly.

A cathode block assembly or cathode block section assembly, is connected to the corresponding bus bar system of the potline via its cathode bar connections. In certain modifications, the cathode bar connections can have either increased or decreased electrical conductivity.

Such cathode bar connections comprise commonly flexibles made of copper. In certain modifications, the flexibles can have less electrical conductivity (higher electrical resistance).

In certain modifications, the cathode bar connections including the outer part of the cathode bar has improved electrical conductivity, for instance the outer part of it being provided with an additional element of a material with good electrical conductivity, such as a copper based extension.

These modifications will be explained further with reference to FIGS. 12-16

As shown in FIG. 1 there is disclosed a schematic top view of an electrolysis cell, with two long sides and two short sides and where I-I indicates a central axis. The cathode panel may consist of several cathode blocs. In this simplified figure there is shown eight cathode blocks, extending between the long sides of the cell. Further, a cathode block assembly commonly comprises at least one carbon based block or body with one or more metallic collector bars embedded therein.

As a starting point, the individual cathode blocks may be divided in two cathode block sections along the central axis I-I, as slightly indicated in the figure at positions 1', 1"; 2', 2"; 3', 3"; 4', 4"; 5', 5"; 6', 6"; 7', 7"; and 8', 8". The cathode block sections from 1', 1" and up to 8', 8" may be symmetrical in the sense of electrical conductivity with regard to the central axis I-I, indicated by the dashed and broken line in FIG. 1. Thus, in that context the central axis I-I will represent an axis of symmetry with regard to the electrical conductivity of all cathode blocks.

In the embodiment shown, the striped blocks are unmodified cathode block assemblies with a characteristic current path as in FIG. 2, while the white blocks are modified cathode block assemblies with a characteristic current path (less horizontal currents) as shown in FIG. 3.

Further in FIG. 1, there is shown the direction of the x-axis and y-axis in a coordinate system. The z-axis is not disclosed, but is pointing out of the paper plane, which is standard in this type of visualization.

At unmodified cathode block section assembly 2" the current paths at cross-section B-B is monitored in FIG. 2, and at modified cathode block section assembly 6" the current paths at cross-section A-A is monitored in FIG. 3.

In FIG. 2 there is disclosed typical current paths of a normal, un-modified cathode block section assembly, as seen at cathode block section assembly 2" and cross-section B-B in FIG. 1. This illustrates that the current paths in the z-y plane flattens out along the y-axis, from the central axis I-I and towards the cell's long side in direction y. Since z here is arranged in the vertical plane along the central axis I-I, a similar, mirror-symmetric, current paths may be present in a correspondingly un-modified cathode block section assembly 2'.

In FIG. 3 there is disclosed current paths in a modified cathode block section assembly, as disclosed at cathode block section assembly 6" and cross-section A-A in FIG. 1. The current paths are steeper in the vertical direction and thereby the horizontal current components are reduced. Similar to that of cathode block section assembly 2", similar mirror-symmetric current paths may be present in cathode block section assembly 6', given this have a similar modification as that of cathode block section assembly 6".

As shown in FIG. 4 there is disclosed an example of a normal current distribution in a state of the art cell.

FIG. 5 discloses the current distribution after individual cathodes in the cathode panel has been selectively modified, according to FIG. 1.

As shown in FIG. 6 there is disclosed force components ($F_x$) in metal due to the magnetic field in the z-direction for a normal cell.

In FIG. 7 the corresponding force components are disclosed for a selectively modified cell according to FIG. 1. It can clearly be seen that the force components are lower in the region of which the cathode current distribution is modified by the reduction of horizontal current components.

As shown in FIG. 8, modelled metal heights are disclosed for a normal cell.

Correspondingly, FIG. 9 discloses the modelled metal heights for a modified cell according to that of FIG. 1.

The variation of metal height is considerably higher for the unmodified cell with its lowest height at the at the right hand side, being considerable lower than at the left hand side. For the modified cell the total metal heaving is lower and the metal is more evenly distributed between left and right side of the cell.

As shown in FIG. 10, measured metal heights for normal cells are disclosed. The y-position of the upstream measurement points are given by the midplane between the lower end of the cell and the cell center (I-I) in FIG. 1, as indicated by the thin dotted line marked US (Upstream). The y-position of the downstream measurement points are given by the midplane between the lower end of the cell and the cell center (I-I) in FIG. 1, as indicated by the thin dotted line marked DS (Downstream). The x-position for all measurement point increases monotonically from measurement point 1 to 5 starting from the left side of the cell to the right side of the cell. The actual cell measured on has not the same cathode block assembly as shown in FIG. 1.

Correspondingly, the same is shown for modified cells in FIG. 11. In addition to a reduced overall heaving for the modified case the results show a more even distribution of metal between left and right hand side of cell.

The following modifications will increase electrical conductivity in the cathode block assembly see also FIG. 12:

CBS: Cathode block section

CB: Cathode block

CCB: Cathode collector bar

CBSA: Cathode block section assembly

CBA: Cathode block assembly

F: Flexible a: Flexible with reduced cross section or the similar b: Cu extension or similar BUS: Busbar connection i) Cathode block quality, i.e. the electrical conductivity of the carbon based body may vary along the length of the body, commonly with higher conductivity towards the centre of the cell, or be modified as a whole, ii) Cathode collector bars with improved conductivity, for instance by use of Cu inserts iii) Cathode collector bar dimension (cross-section increase) to reduce the voltage drop The following modifications will decrease electrical conductivity in the cathode block assembly:

iv) Various methods for insulating electrically the cathode bar from the carbon based cathode block v) Reduced electrical conductivity in the modified cathode block Preferably, the electrical conductivity of the modified cathode block assembly and its corresponding cathode bar connection to the bus bar system is kept unmodified as a whole.

The electrical conductivity of the cathode bar connection can be reduced by:

a) Reducing the cross section of the copper flexible or the similar

The electrical conductivity of the cathode bar connection can be increased by:

b) Adding a copper extension or the similar

When implementing the modifications in the cell, it is preferred to keep the total resistivity of the cathode block assembly together with its collector bar connection(s) constant. One alternative is to modify the collector bar connections at the unmodified positions to have the same resistance in all positions of the cathode panel.

For instance, a reduced cathode collector bar resistivity (method ii or iii) in selected blocks will result in reduced horizontal current components ($i_y$) in the metal zone. The reduction in cathode collector bar resistivity can be compensated by increased resistivity of the corresponding cathode bar connection by increasing the resistivity of the flexibles (reduced cross section) connecting the bus bar system. In the alternative, the cathode bar connections for the rest of cathode block assemblies can be modified with better electrical conductivity, corresponding to that of the modified one.

With reference to FIG. 13 there is disclosed a schematic top view of an electrolysis cell similar to that of FIG. 1 where the electrical conductivity of the cathode block section assemblies in position 1", 2" and 3" is increased according to method I, ii and iii respectively and where the flexibles have reduced electrical conductivity according to method a for modification of the cathode bar connection. The rest of the positions are unmodified.

With reference to FIG. 14 it is disclosed the same modifications of the electrical conductivity of the cathode block section assemblies in pos 1", 2" and 3" as in FIG. 13, but here the electrical conductivity of the cathode bar connections is modified according to method b (increased) in all positions except positions 1" 2" and 3".

With reference to FIG. 15 there is disclosed a schematic top view of an electrolysis cell similar to that of FIG. 1 where the electrical conductivity of the cathode block section assemblies in pos 4" and 5" is decreased according to method iv and v respectively and where the cathode bar connection is modified according to method b. The rest of the positions are unmodified.

With reference to FIG. 16 it is disclosed the same modifications of the electrical conductivity of the cathode block section assemblies in positions 4" and 5" as in FIG. 15, but here the electrical conductivity of the cathode bar connections is modified according to method a (decreased) in all positions except positions 4" and 5".

An overall reduction of the horizontal current component ($i_y$) in the metal zone will in general reduce metal heaving. The current component is multiplied (cross product) with the vertical magnetic field $B_Z$ and is therefore responsible for the horizontal force field $F_x$ that acts on the metal along the cell's extension, that is pushing metal towards the cell's centre. By reducing the force components in one or several selected cathode block assemblies it is possible to modify the force distribution in the cell and consequently re-distribute the metal distribution in the cell.

In some modifications, a reduction in cathode flexible's cross section is adjusted to keep the resistivity in the cathode assembly constant. An alternative method for achieving the same is to increase the length of the electrical insulation between the cathode collector bar and the cathode block.

According to this example, the metal heaving and MHD stability for all possible modifications is calculated, but with only one modification for each calculation. The calculations is assisted by establishing a model of the actual electrolysis cell in computer based modelling program where each cathode block assembly or cathode block section assembly is represented. The modelling program is able to identify which cathode block assembly or cathode block section assembly that preferably should be modified. Then the most promising modification(-s) should be implemented in the cell. The cell can be built greenfield with the modification (-s) or brownfield as a part of ordinary re-lining maintenance.

The most important steps are:

Establish a representative model for a normal cathode design for all cathode positions. The number of cathode block assemblies or cathode block section assemblies and the corresponding design of cathode bars must be defined.

the selection of which cathode bars to be modified in the computer based modelling operation is performed according to the following steps:

start with a normal cathode design for all cathode positions 1-*n*, the number n being the number of cathode blocks or cathode block sections, the corresponding design of cathode bars must be defined, for instance being two bars for a typical cathode block, modify cathode bar 1 in pos. 1 with reduced cathode bar resistivity and optionally a corresponding increase in cathode flexible resistivity to reach the same overall resistivity as a normal cathode block or cathode block section, calculate metal heaving and MHD stability and store results, start again with a normal cathode design for all remaining cathode positions 2-*n*, modify cathode bar 2 in pos. 1 with reduced cathode bar resistivity and optionally a corresponding increase in cathode flexible resistivity to reach the same overall resistivity as a normal cathode block or cathode block section, calculate metal heaving and MHD stability and store results, repeat the steps above for all cathode bars and positions, the obtained results are then used to find the promising combinations of modified and non-modified cathode blocks, the promising combinations are thereafter tested by calculating metal heaving and MHD stability.

thereafter at least one modification is implemented in the production cell.

The selection of which cathode bars to be modified can also in an alternative be based on studying the force components and calculate the resulting metal heaving and MHD stability for several selected cases (trial and error).

Based on the results obtained in the detailed description an overview of metal heaving and MHD stability for each modified cathode bar and optionally the flexibles is produced. The overview is then used to analyse which cathode bars that are advantageous to modify with respect to reduction in metal heaving and improved MHD stability.

Based on the above analysis a few designs consisting of at least one cathode bar modification(s) (with corresponding cathode flexible modification(s)) is modelled and calculated.

With low metal heaving, even distribution of metal pad in cell and MHD stability as selection criteria, the best design can then be chosen.

However, all common ways of modifying the electrical conductivity and correspondingly the current distribution of cathode block assemblies or cathode block section assemblies as previously mentioned, may in principle be applied.

The method can be applied for cathode block assemblies or cathode block section assemblies comprising one, two or more cathode bars.

According to model calculations with appropriate modelling tools, collector bar insulation at selected cathodes (asymmetric design) clearly improves metal heaving and instability rate (IR) by reducing the forces that pushes excessive metal into one side of the cell. Improvements in cell operation are expected.

By extending the collector bar insulation at all position a quite large reduction in heaving is observed. Actually by increasing this insulation from 150 mm to 450 all around the cell the heaving is lower than any other solution and the asymmetry is also reduced considerably. However, the increased voltage drop due to longer insulation length must be compensated by for instance use of Cu inserts. Compensation of the increased cathode voltage drop will require more Cu than the other asymmetric designs as Cu is needed at all positions and might be a more expensive solution.

As mentioned above, it should be understood that the modelling of the modification of the cell described in the embodiment above is in principle based upon modifications of the cathode collector bar resistivity versus the cathode block for simplifying reasons. It should be understood that the final modifications in an operating cell can in fact be based upon other ways of modifying the electrical conductivity of the cathode blocks or cathode block sections as mentioned previously as method i-v and cathode bar connection methods a-b.

The invention claimed is:

1. A method for reducing the metal pad unevenness and optimizing the MHD stability in an electrolysis cell of the Hall-Héroult type for aluminium production, the cell having suspended prebaked carbon anodes and a cathode panel comprising several carbon based cathode blocks having one or more collector bars thus forming a cathode block assembly, where said cathode block assembly may be constituted by several individual cathode block sections that together with its cathode collector bars form cathode block section assemblies, the cell further having a metal pad that lies onto the cathode panel and an electrolytic bath between said metal pad and the anodes, where unevenness of the metal pad is detected by measurements or calculations, wherein a model of the electrolysis cell is established in a computer based modelling program where each cathode block assembly or cathode block section assembly is represented, the modelling program being able to identify which cathode block assembly or cathode block section assembly that preferably should be modified, where at least one of the modifications is implemented in the cell by changing selectively the electrical current distribution in individual cathode block assemblies or in cathode block section assemblies so that the local electrical current paths and correspondingly the local forces in the metal above the cathode panel are modified to reduce the unevenness of the metal pad and optimize the overall MHD stability of the cell.

2. The method according to claim 1, wherein the total amount of electrical current extracted by each cathode block assembly or cathode block section assembly is kept constant by the said modification.

3. The method according to claim 1, wherein the total amount of electrical current extracted by each cathode block assembly or cathode block section assembly is kept constant by the said modification, where the cathode bar connections (a, b) to a bus bar system are modified.

4. The method according to claim 1,
wherein
the cathode block or cathode block section quality is modified in that the electrical conductivity of the carbon based block increases toward the centre.

5. The method according to claim 1,
wherein
the electrical conductivity of the cathode collector bars is increased.

6. The method according to claim 1,
wherein
the dimension of the cathode collector bars is increased to reduce the voltage drop.

7. The method according to claim 1,
wherein
the electrical conductivity of the carbon based block or block section is reduced by partly insulating electrically the cathode collector bars from the carbon based block.

8. The method according to claim 1,
wherein
the electrical conductivity of the carbon block in the modified cathode block assembly is reduced.

9. The method according to claim 4,
wherein
in the modified cathode block assembly the electrical conductivity of the cathode bar connection is reduced.

10. The method according to claim 4,
wherein
in the unmodified cathode block assembly the electrical conductivity of the cathode bar connection is increased.

11. The method according to claim 7,
wherein
in the modified cathode block assembly the electrical conductivity of the cathode bar connection is increased.

12. The method according to claim 7,
wherein
in the unmodified cathode block assembly the electrical conductivity of the cathode bar connection is reduced.

13. The method according to claim 1,
wherein
the cathode panel resistance is maintained unmodified as a whole by applying combinations of more one or more methods in the following group i) and each the following group ii):
group i):
the cathode block or cathode block section quality is modified in that the electrical conductivity of the carbon based block increases toward the centre;
the electrical conductivity of the cathode collector bars is increased;
the dimension of the cathode collector bars is increased to reduce the voltage drop;
the electrical conductivity of the carbon based block or block section is reduced by partly insulating electrically the cathode collector bars from the carbon based block; and
the electrical conductivity of the carbon block in the modified cathode block assembly is reduced; and
group ii):
in the modified cathode block assembly the electrical conductivity of the cathode bar connection is reduced;
in the unmodified cathode block assembly the electrical conductivity of the cathode bar connection is increased;
in the modified cathode block assembly the electrical conductivity of the cathode bar connection is increased; and
in the unmodified cathode block assembly the electrical conductivity of the cathode bar connection is reduced.

14. The method according to claim 1, where the selection of which cathode bars to be modified in the computer based modelling operation is performed according to the following steps:
start with a normal cathode design for all cathode positions 1-*n*, the number n being the number of cathode blocks or cathode block sections,
the corresponding design of cathode bars must be defined,
modify cathode bar 1 in pos. 1 with reduced cathode bar resistivity and optionally a corresponding increase in cathode flexible resistivity to reach the same overall resistivity as a normal cathode block or cathode block section, calculate metal heaving and MHD stability and store results,
start again with a normal cathode design for all remaining cathode positions 2-*n*,
modify cathode bar 2 in pos. 1 with reduced cathode bar resistivity and optionally a corresponding increase in cathode flexible resistivity to reach the same overall resistivity as a normal cathode block or cathode block section, calculate metal heaving and MHD stability and store results,
repeat the steps above for all cathode bars and positions,
the obtained results are then used to find the promising combinations of modified and non-modified cathode blocks,
the promising combinations are thereafter tested by calculating metal heaving and MHD stability,
thereafter at least one modification is implemented in the production cell.

15. The method according to claim 10,
wherein
a simplified model of the cell comprises several cathode block assemblies representing one position.

16. An electrolysis cell for aluminium production of the Hall-Héroult type with reduced metal pad unevenness and optimization of MIND stability modified in accordance with the method of claim 1, the cell having suspended prebaked carbon anodes and a cathode panel comprising several carbon based cathode blocks or cathode block sections with cathode collector bars, and further a metal pad and an electrolytic bath between said anodes and the cathode panel,
wherein
the local electrical current paths and correspondingly the local forces in the metal above the cathode panel are modified where the electrical current distribution (less horizontal currents components) in at least one individual cathode block or cathode block section is modified and differs from the others.

17. The electrolysis cell according to claim 16
wherein
the electrical conductivity of at least one carbon based block or block section is different from that of the unmodified blocks.

18. The electrolysis cell according to claim 16,
wherein
the at least one cathode block or cathode block section is modified in that the electrical conductivity of the carbon based block vary along the length of the block or block section.

19. The electrolysis cell according to claim 16, wherein the electrical conductivity of the cathode collector bars is improved.

20. The electrolysis cell according to claim 16, wherein the dimensions of the cathode collector bars are larger in at least one cathode block or cathode block section.

21. The electrolysis cell according to claim 16, wherein at least one cathode block or cathode block section has collector bars that are electrically insulated in a different manner versus the carbon based block or carbon based block section than that of the rest of the cathode blocks or cathode block sections.

22. The electrolysis cell according to claim 16, wherein the total amount of electrical current extracted by each cathode block assembly or cathode block section assembly is kept constant by the said modification, where the cathode bar connections (a, b) to a bus bar system are modified.

* * * * *